US009435604B2

(12) United States Patent
Zusman

(10) Patent No.: US 9,435,604 B2
(45) Date of Patent: Sep. 6, 2016

(54) TRAINING RIFLE AND MAGAZINE

(71) Applicant: Nisim Zusman, Ein Ayala (IL)

(72) Inventor: Nisim Zusman, Ein Ayala (IL)

( * ) Notice: Subject to any disclaimer, the term of this patent is extended or adjusted under 35 U.S.C. 154(b) by 23 days.

(21) Appl. No.: 13/907,835

(22) Filed: May 31, 2013

(65) Prior Publication Data

US 2014/0356816 A1 Dec. 4, 2014

(51) Int. Cl.

| | |
|---|---|
| ***F41A 33/00*** | (2006.01) |
| *F41A 9/65* | (2006.01) |
| *F41A 17/38* | (2006.01) |

(52) U.S. Cl.

CPC ..... *F41A 33/00* (2013.01); *F41A 9/65* (2013.01); *F41A 17/38* (2013.01)

(58) Field of Classification Search

CPC ..... F41A 33/00; F41A 33/02; F41A 33/04; F41A 33/06; F41A 9/65; F41A 17/38; A63H 33/30

USPC ..... 434/11–6, 11–62

See application file for complete search history.

(56) References Cited

U.S. PATENT DOCUMENTS

| | | | | |
|---|---|---|---|---|
| D746,398 | S | 12/2015 | DeLuca | |
| 2007/0199435 | A1* | 8/2007 | Hochstrate et al. | 89/191.02 |
| 2014/0272806 | A1* | 9/2014 | Hunt | 434/16 |

OTHER PUBLICATIONS

Product Information Safe-T-Gun, 2014, p. 1, Diamondhead USA, Inc., West Springfield, Massachusetts, www.Diamondhead-USA.com.

* cited by examiner

*Primary Examiner* — Timothy A Musselman

(74) *Attorney, Agent, or Firm* — Law Office of Arthur M. Antonelli, PLLC

(57) ABSTRACT

The present invention is directed to a polymer training rifle which may include a modular receiver portion, a simulated barrel nut, one or more interchangeable modular barrels, and a receiver extension tube. Selected parts and tactical accessories may be connected to the rifle training system to provide a customized training rifle. The modular receiver may include a magazine well that receives an actual magazine or an inert replica magazine. The receiver portion also may include a functional magazine catch assembly which allows a trainee to selectively secure and release a magazine from the magazine well. The one or more modular barrels, modular receiver portion, and inert replica magazine may each include a metal core to allow for detection by security screening equipment.

20 Claims, 7 Drawing Sheets

TRAINING RIFLE AND MAGAZINE

FIELD OF THE INVENTION

The present invention generally relates to an inert, training rifle and magazine that may be used for law enforcement and military training. More particularly, this invention relates to a modular, inert, replica rifle that is configured to receive interchangeable modular barrels, aftermarket parts, and tactical accessories.

BACKGROUND

Inert training rifles may be used by law enforcement and military personnel to simulate live fire training A need exits, however, for a modular training rifle that allows a user to customize the training rifle with interchangeable modular barrels, selected parts, and tactical accessories to more accurately simulate a trainee's duty weapon, and thereby provide a more realistic training experience.

SUMMARY

Hence, the present invention is directed to an inert, modular training rifle which may include an interchangeable modular barrel having a proximal end, a distal end, and a first longitudinal axis extending from the proximal end to the distal end.

In one aspect, the training rifle may include a barrel extension segment adjacent the proximal end. The barrel extension segment may include a tapered cylindrical portion aligned with the first longitudinal axis and a projection extending from the tapered cylindrical portion. The projection may include a first slot aligned with the first longitudinal axis and a second slot perpendicular to the first slot. The second slot may intersect the first slot. A fastener attachment member, including a threaded opening, may be disposed in the second slot. The threaded opening also may be aligned with the first slot.

The training rifle also may include a modular receiver. The modular receiver may have a front end and a rear end. The modular receiver may include a barrel attachment site on the front end. The barrel attachment site may include a rim which defines a first projection, and an opening extending from the first projection into the modular receiver. The opening may define a socket for receiving the barrel extension segment. The socket may include an upper end wall, a lower end wall, and a surface connecting the upper end wall to the lower end wall.

The modular receiver may include a receiver extension tube attachment site on the rear end of the modular receiver. The receiver extension tube attachment site may include a threaded cylindrical bore extending from the rear end into the modular receiver. Additionally, the training rifle may include a cavity within the modular receiver, the cavity being situated between the threaded cylindrical bore and an interior end wall that is spaced from the socket. A passage may extend from the interior end wall to the upper end wall. A fastener which comprises a head and an elongated body may be deployed in the modular receiver such that the fastener head is disposed in the cavity, the elongated body is disposed in the passage, and a portion of the elongated body mates with the threaded opening of the fastener attachment member to fix the barrel extension segment within the socket.

In another aspect, the inert modular barrel further may include a cross bore having a second longitudinal axis that is substantially perpendicular to the first longitudinal axis. The cross bore being disposed between the barrel extension segment and the distal end. A retaining ring may be disposed between the barrel extension segment and the cross bore. Also, the retaining ring may abut the rim.

In another aspect, the training rifle may include a barrel nut that locks the retaining ring against the rim. The barrel nut may include a pair of opposing holes. A spring pin may be disposed in the cross bore and in the pair of opposing holes to block relative movement between the barrel extension segment and the modular receiver.

In another aspect, the training rifle may include a pistol grip attachment site. The pistol grip attachment site may include a fastener bore, a window connected to the fastener bore, and a square nut disposed in the window.

In another aspect, the modular receiver may include a metal core. The inert modular barrel also may include a metal core.

In another aspect, the projection extending from the tapered cylindrical portion may have a hemispherical cross-sectional profile.

In another aspect, a receiver extension tube may be connected to the receiver extension tube attachment site. The receiver extension tube may include four notches for capturing a rifle stock locking pin.

In another aspect, the modular receiver may include a Picatinny rail.

In another aspect, the modular barrel and receiver portion may be connected to simulate a carbine having a 16-inch barrel length.

In another aspect, the modular barrel and receiver portion may be connected to simulate a mid-length rifle having a 16-inch barrel length.

In another aspect, the modular barrel and receiver portion may be connected to simulate a rifle having a 20-inch barrel length.

In another aspect, the modular receiver may include a magazine well and a magazine catch assembly. The magazine catch assembly may include a magazine catch button and a magazine catch.

In another aspect, the modular receiver may include a ridged portion above the magazine well such that the ridged portion simulates the contour of a bolt carrier. Also, the training rifle may include a magazine. The magazine may include a spring loaded member. The magazine may be loaded into the magazine well and locked in the magazine well by the magazine catch. Contact pressure from the ridged portion against the spring loaded member may compress the spring loaded member. The magazine may be an inert training magazine which includes a metal core.

DESCRIPTION OF THE DRAWINGS

In the accompanying drawings, which form a part of the specification and are to be read in conjunction therewith and in which like reference numerals are used to indicate like parts in the various views.

DESCRIPTION

Figure 1:
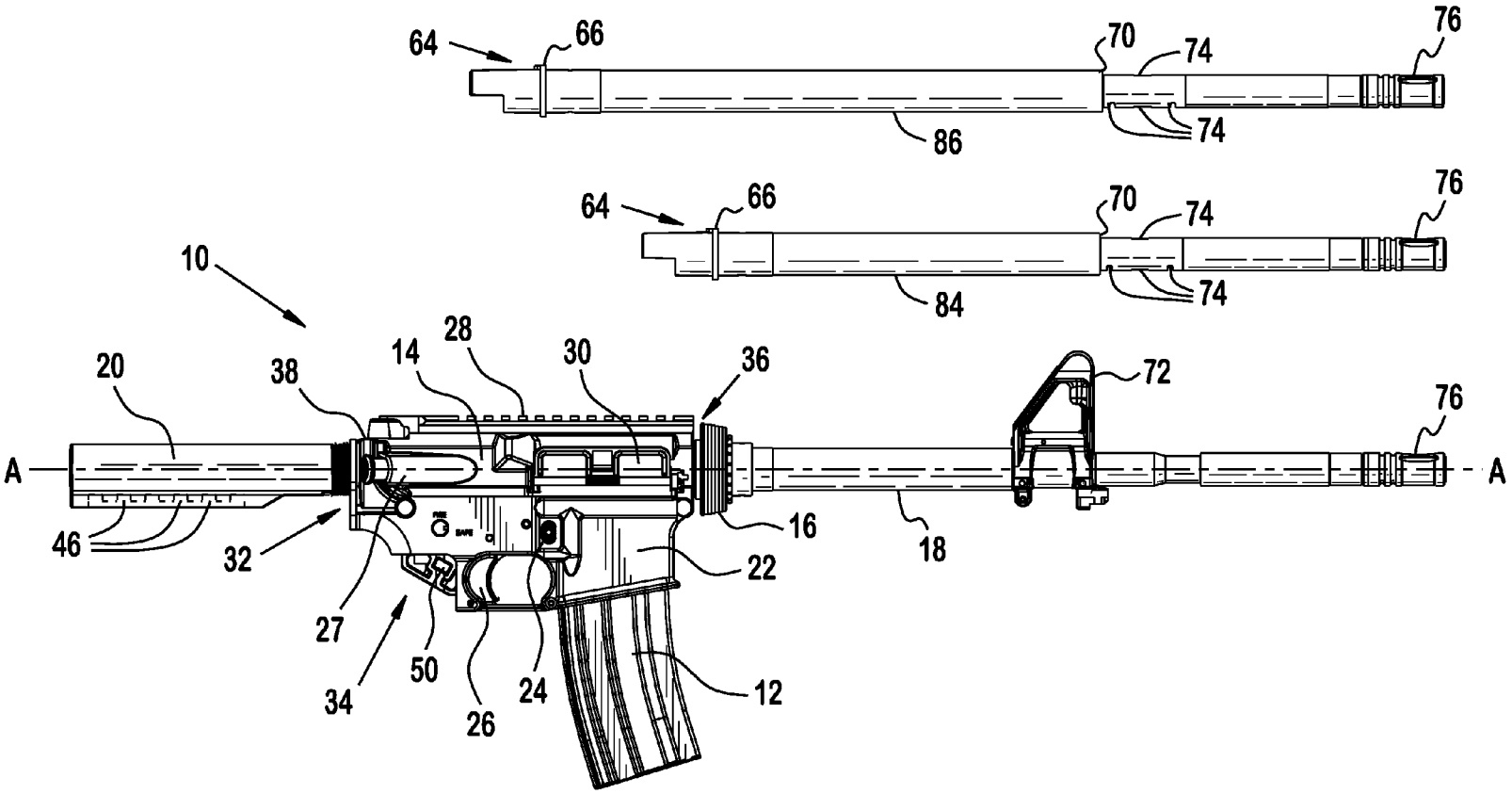
FIG. 1 is a left side view of an embodiment of a modular training rifle, training magazine, and two interchangeable barrels of the present invention.

FIG. 1 shows an embodiment of a modular, inert, replica, training rifle 10 and magazine 12 of the present invention. The training rifle 10 may include a modular receiver portion 14, a simulated barrel nut 16, an interchangeable modular barrel 18, and a receiver extension tube 20. The training rifle 10 may have a longitudinal axis A-A. Two other exemplary interchangeable modular barrels 84, 86 are shown with common features designated with like reference numerals. Additionally, the receiver portion 14 may include a magazine well 22 that is configured and dimensioned to receive the magazine. The receiver portion further may include a functional magazine catch button 24, which interacts with a magazine catch 25 (see FIG. 8) to selectively secure and release the magazine 12 from the magazine well. In this embodiment, the training rifle is a replica of an AR-15 series rifle, and thus the receiver portion may simulate features of an AR-15 series rifle. Simulated features may include a trigger 26, a forward assist 27, a 1913 Mil-Spec Picatinny rail 28, and an ejection port cover 30.

The receiver portion 14 further may include modular component attachment sites, including a receiver extension tube attachment site 32, a pistol grip attachment site 34, and a barrel attachment site 36. Generally, the components of the training rifle may be formed from polymer materials. Preferably, a suitable polymer may be selected from the polyamide family of materials. For instance, the polymer nylon-6,6 may be used. Nevertheless, each modular component may include a metal core to allow for detection by metal detectors and other conventional security screening techniques.

Figure 3:
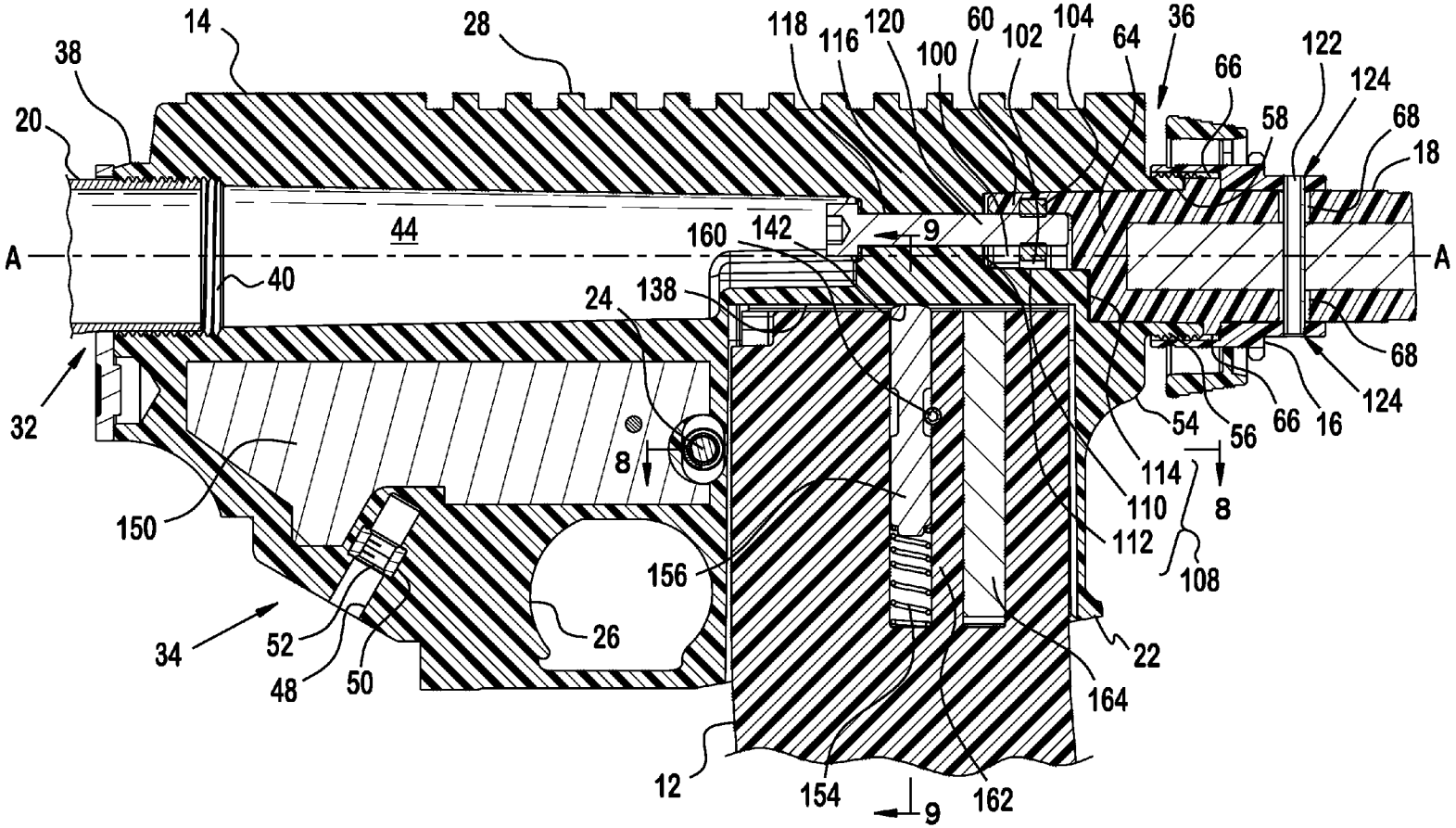
FIG. 3 is a sectional view of the training rifle along the vertical plane through the longitudinal axis A-A of FIG. 1.

Referring to FIG. 3, the extension tube attachment site 32 may be disposed on the rear side 38 of the receiver portion 14. The extension tube attachment site may include a threaded cylindrical bore 40 which is configured and dimensioned to receive and mate with a receiver extension tube 20. The threaded cylindrical bore 40 may be part of a larger cavity 44 within the receiver portion. The receiver extension tube 20 may have the correct configuration, length and outside diameter of a Mil-Spec or commercial receiver extension tube. For instance, a Mil-Spec receiver extension tube may have a flat back, a length of 7.25 inches and a buffer tube outer diameter of 1.148 inches. Referring to FIG. 1, the threaded portion of the Mil-Spec receiver extension tube may have an outer diameter of 1.185 inches. Also the military grade tube may have at least four notches 46 on the underside of the receiver extension tube to capture a stock's locking pin to allow for quick, positive stock length adjustments. By contrast, a commercial receiver extension tube may have a slanted back, an approximate length of 7.25 inches and a buffer tube outer diameter of 1.168 inches. Additionally, the threaded portion of the commercial receiver extension tube may have an outer diameter of 1.170 inches. The commercial grade tube may have six notches 46 on the underside of the receiver extension tube to capture a stock's locking pin to allow for quick, positive stock length adjustments.

Referring to FIG. 3, the pistol grip attachment site 34 may be disposed adjacent to the trigger 26 and may be configured to receive a drop in replacement for a pistol grip for an AR-15 series of rifles. The pistol grip attachment site 34 may include a fastener bore 48 that extends into a window 50 that may house a square nut 52. A pistol grip may be seated on the pistol grip attachment site 34 and secured to the receiver portion 14 with a threaded fastener (not shown) that is positioned within the fastener bore 48 and advanced into the square nut 52.

The barrel attachment site 36 may be disposed on the front side 54 of the receiver portion 14. The barrel attachment site 36 may include a threaded rim 56 which defines an opening 58 in the receiver portion that receives and mates with the proximal end 60 of the training rifle barrel 18 to anchor the barrel 18 within the receiver portion 14. A simulated barrel nut 16 may be used to secure the barrel 18 to the threaded rim 56 on the receiver portion. The simulated barrel nut 16 also may be used to secure floating hand guards to the barrel.

Figure 6:
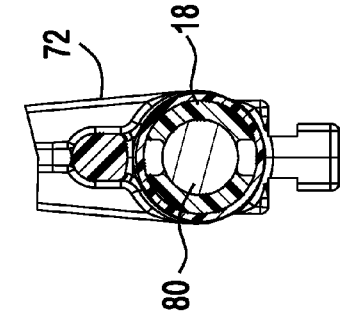
FIG. 6 is a sectional view of the front sight and barrel along line 6-6 of FIG. 1.
Figure 5:
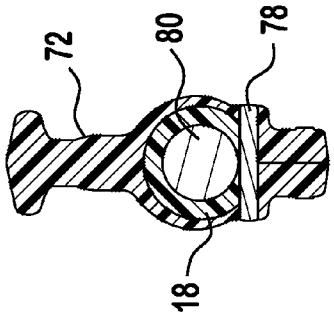
FIG. 5 is a sectional view of the front sight and barrel along line 5-5 of FIG. 1.
Figure 4:
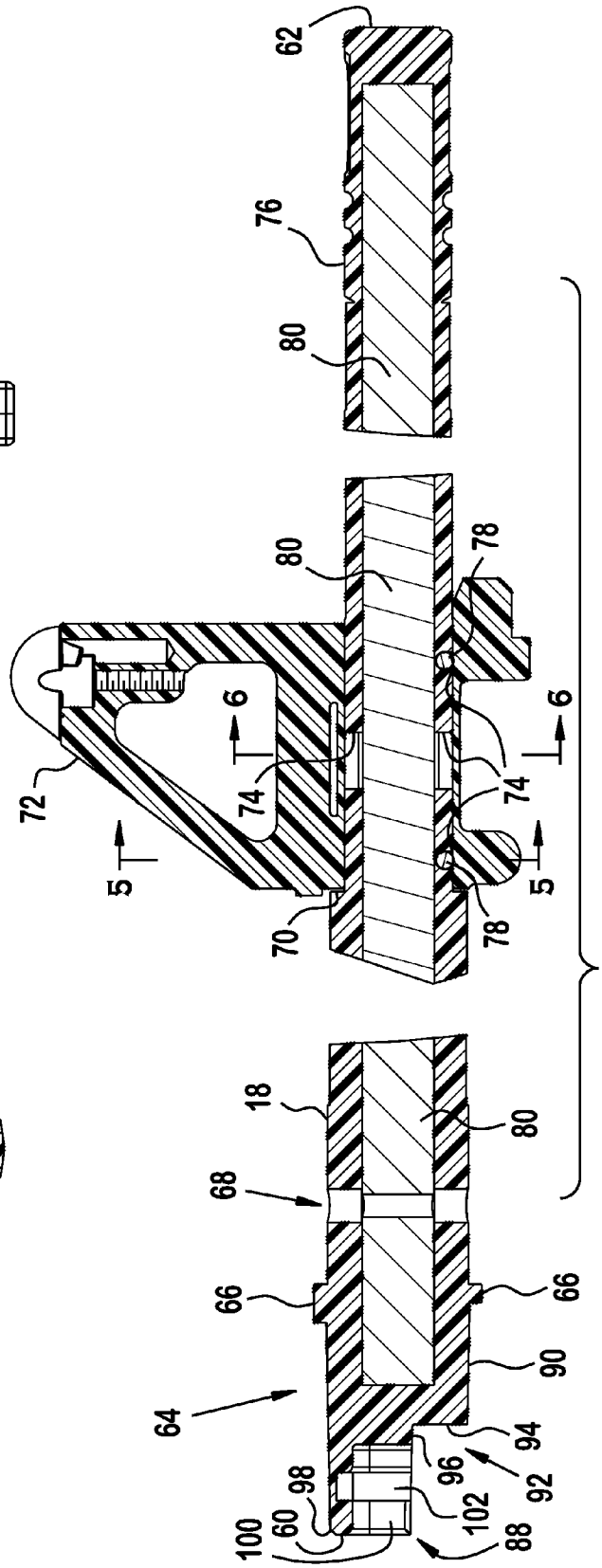
FIG. 4 is a broken sectional view of the barrel of the training rifle of FIG. 1.

Referring to FIG. 4 the barrel 16 of the training rifle 10 may include a barrel extension 64, a bore for a retaining pin 68, a shoulder 70, a front sight 72, notches for receiving the front sight 74, and a simulated flash suppressor 76. Referring to FIGS. 4-6, the front sight 72 may be secured to the barrel 18 with a pair of tapered pins 78. The simulated flash suppressor 76 may have a smaller diameter than the actual flash suppressors used on the firearm being simulated in order to allow the front sight to slide on and off the barrel. The barrel 18 may be formed from polymer about a metal core 80. The metal core 80 may be, for example, a medium carbon steel. Referring to FIG. 1, a first modular barrel 18 is shown assembled to the receiver portion 14, which is configured and dimensioned to simulate an AR-15 series carbine with a 16-inch barrel. A second modular barrel 84 is shown which is configured and dimensioned to simulate a 16-inch mid-sized rifle barrel. The shoulder 70 of the second modular barrel is 2 inches closer to the flash suppressor 76. Also, a third modular barrel 86 is shown which is configured and dimensioned to simulate a 20-inch rifle barrel.

Figure 11:
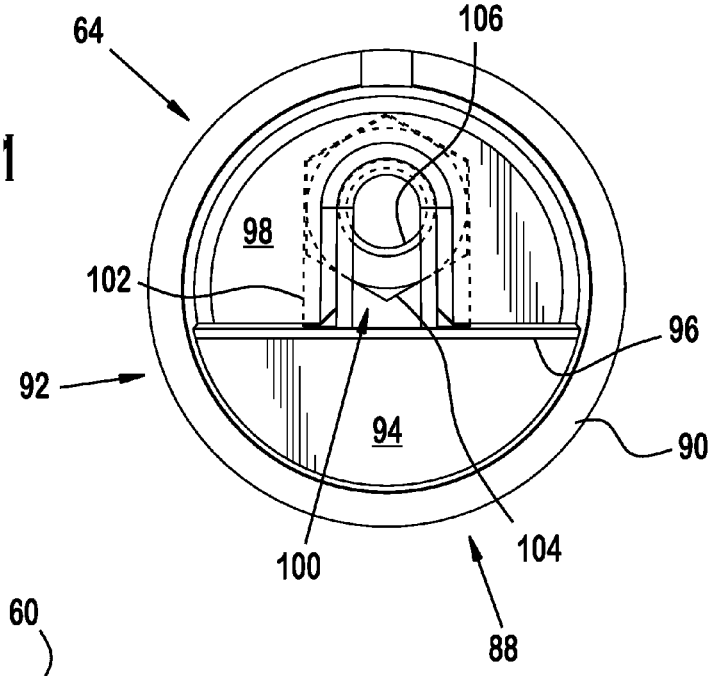
FIG. 11 is a left side view of the barrel of FIG. 4.
Figure 12:
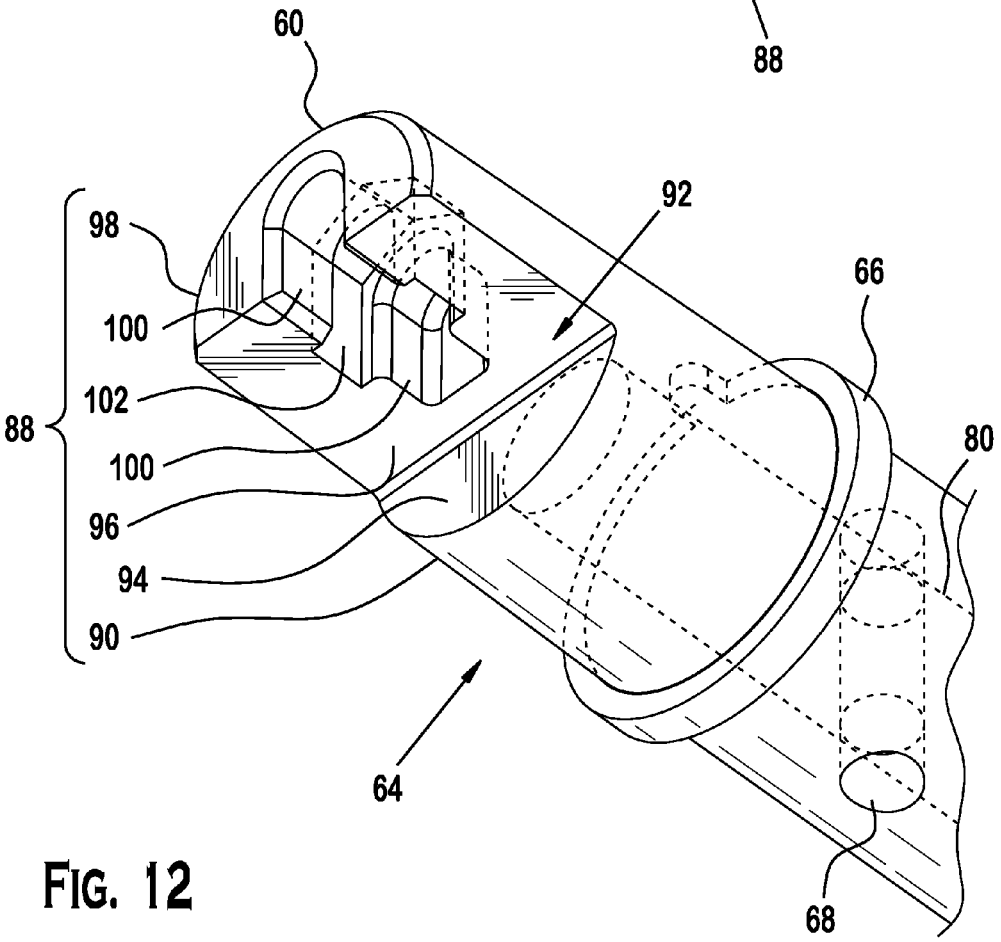
FIG. 12 is a perspective view of the proximal end of the barrel of FIG. 4.

Referring to FIGS. 4, 11 and 12, the barrel extension 64 of each modular barrel may have an interface 88 for connecting to the barrel attachment site 36. The interface 88 may include a tapered cylindrical portion 90 which is configured and dimensioned to fit tightly in the opening 58 (shown in FIG. 3). The interface 88 further may include a step 92 which may be defined by a shoulder 94 on the tapered cylindrical portion, as well as an abutting perpendicular surface 96 that defines the lower surface of a hemispherical projection 98. The hemispherical projection 98 may include a first vertical slot 100 which extends from the proximal end 60 of the barrel toward the distal end 62 of the barrel. The first vertical slot 100 may intersect the abutting perpendicular surface 96 which defines the lower surface of the hemispherical projection 98.

As best shown in FIG. 12, the lower surface 96 of the hemispherical projection 98 may include a second vertical slot 102, which intersects the first vertical slot 100. The second vertical slot 102 may be substantially perpendicular to the first vertical slot 100. The second vertical slot may be configured and dimensioned to receive a hex nut. As best shown in FIG. 11, the hex nut 104 may include a threaded opening 106 for receiving a fastener having mating screw threads. The hex nut may 104 be positioned in the second vertical slot 102 such that the threaded opening 106 of the hex nut is aligned with the first vertical slot 100 at the intersection of the first and second vertical slots. In this manner, the hex nut 106 may be captured within the hemispherical projection 98.

Referring to FIG. 3, the barrel extension 64 may include an interface 88 (see FIG. 12) which mates with complementary features 108 in the opening 58 of the receiver portion. The interface 88 may be configured to provide a connection that resists rotation between the barrel 18 and the receiver portion 14. For example, the complementary features 108 may include a top hemispherical recess 110 which includes an upper end wall 112 and a lower end wall 114. The upper end wall 112 may include a passage 118 that extends through the body 116 of the receiver portion into the cavity 44 that includes the receiver extension tube attachment site 32. A threaded fastener (e.g., a threaded socket screw) 120 may be inserted into the passage 118 from the cavity 44 and advanced through the first vertical slot 100 and into the mating hex nut 104 which is disposed within the second vertical slot 102. The threaded fastener 120 may be advanced within the hex nut 104 to draw the barrel extension 64 tightly into the opening 58, thereby fixing the barrel 18 to the receiver portion 14. These components may located along the longitudinal axis A-A of the training rifle 10.

Additionally, the simulated barrel nut 16 may be slipped over the barrel 18 and locked into place with a spring pin 122 which passes through opposing holes 124 in the barrel nut and a cross bore 68 in the barrel. Alternatively, a threaded barrel nut (not shown) may be slipped over the barrel 18 and advanced onto the threaded rim 56 to form a secure connection. In this manner, the simulated barrel nut (or threaded barrel nut) may lock the retaining ring 66 of the barrel 18 against the threaded rim 56 of the receiver portion 14 to further secure the assembly.

Figure 8:
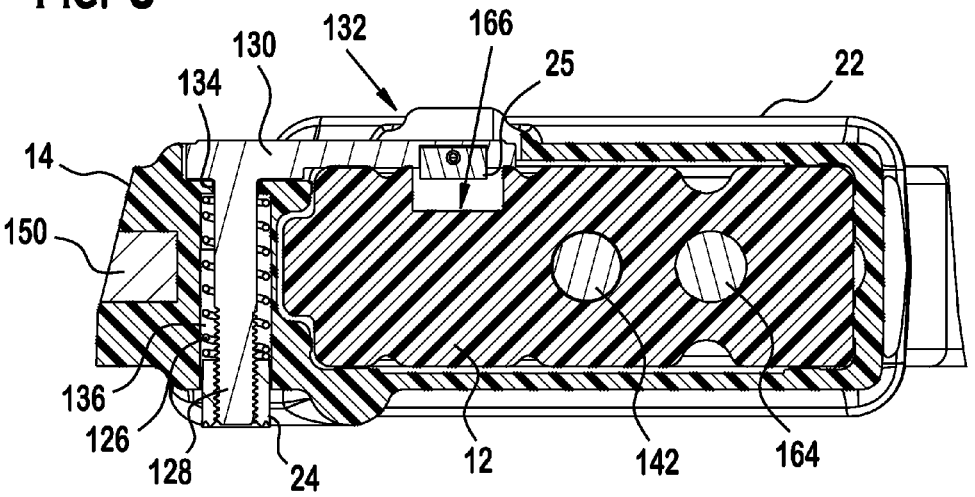
FIG. 8 is a sectional view of the training rifle and magazine along line 8-8 of FIG. 1.

The receiver portion 14 may include a magazine well 22 with a functional magazine catch button 24. As best shown in FIG. 8, the magazine catch assembly may include a magazine catch button 24, a compression spring 126, a partially threaded shaft 128, a plate 130 and a catch 25. The plate 130 and catch 25 may be disposed on the outside of the magazine well 22. The catch 25, however, may be positioned in an opening 132 in the magazine well 22. The stem 128 may be inserted into a narrow opening 134 which expands to a larger diameter as it traverses the receiver portion adjacent the magazine well. A compression spring 126 may be seated about the stem 128 in the expanded passage 136. A magazine catch button 24 may be screwed onto the stem 128 to compress the spring 126 and pull the magazine catch assembly into a stable configuration. Thereafter, pushing the magazine catch button 24 compresses the spring 126 and translates the plate 130 and catch 25 away from the opening 132 in the magazine well. Releasing the depressed magazine catch button 24 allows the spring 126 to elongate and draw the plate 130 and catch 25 toward the magazine well 22 and into the preset or stable configuration. The magazine catch button, stem, plate and catch may be formed from polymer materials as described above.

Figure 9:
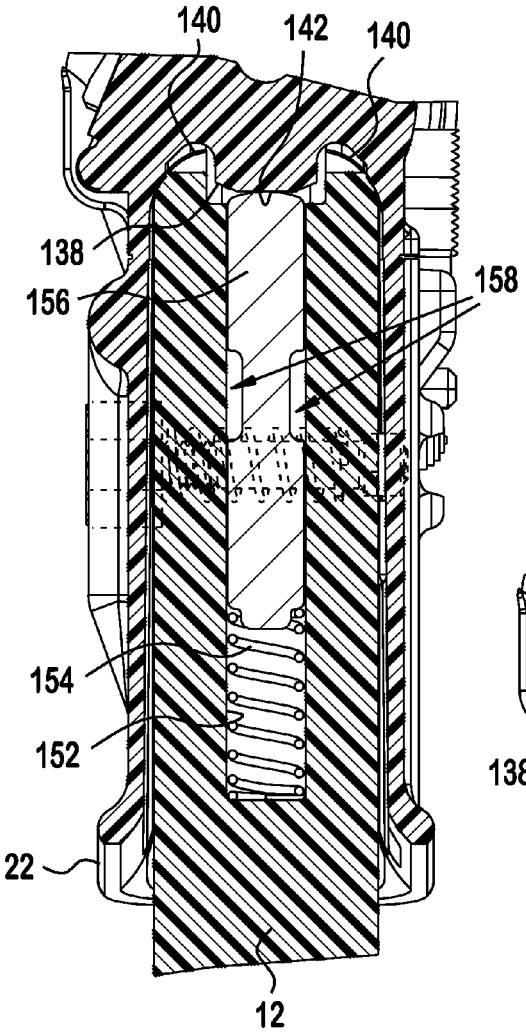
FIG. 9 is a sectional view of the training rifle and magazine along line 9-9 of FIG. 1.
Figure 10:
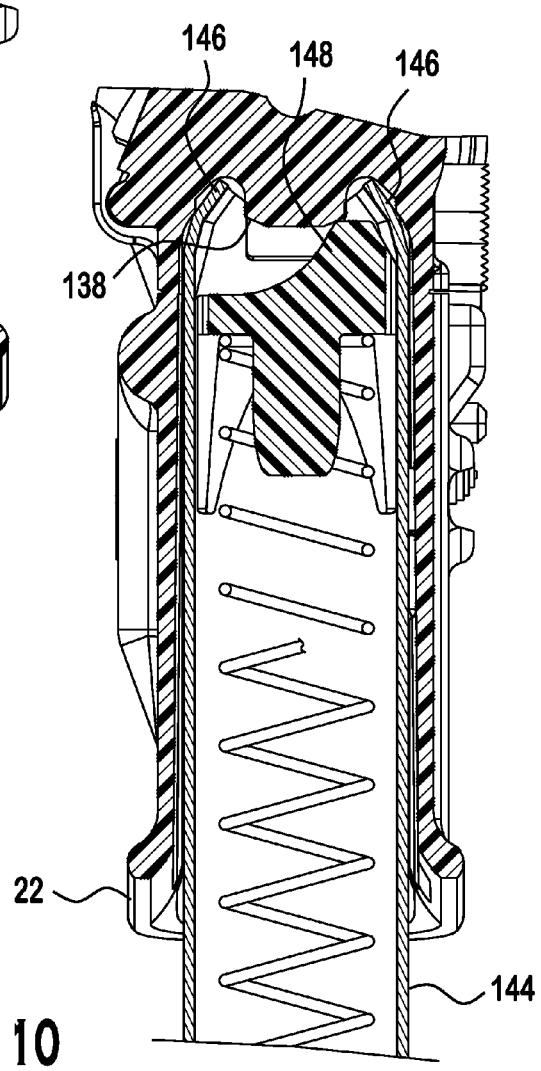
FIG. 10 is a sectional view of the training rifle and another embodiment of a magazine along line 9-9 of FIG. 1.

The magazine well 22 may be configured and dimensioned to receive and selectively hold a magazine of ammunition for an AR-15 series rifle. Referring to FIG. 3, a ridged portion of the receiver 138 at the top of the magazine well 22 may be contoured to simulate a bolt carrier. As shown in FIG. 9, the ridged portion 138 may be contoured to project inside the lips 140 of in inert magazine replica 12 and press against a spring loaded button 142. Similarly, as shown in FIG. 10, the ridged portion 138 may project inside the lips 146 of a real magazine 144 to press against any stored ammunition or the magazine follower 148. Referring to FIG. 8, the receiver portion 14 may include a metal core 150 to make the training rifle visible to metal detectors, x-ray machines or other security screening equipment. The metal core may be made, for example, from low carbon steel.

Figure 7:
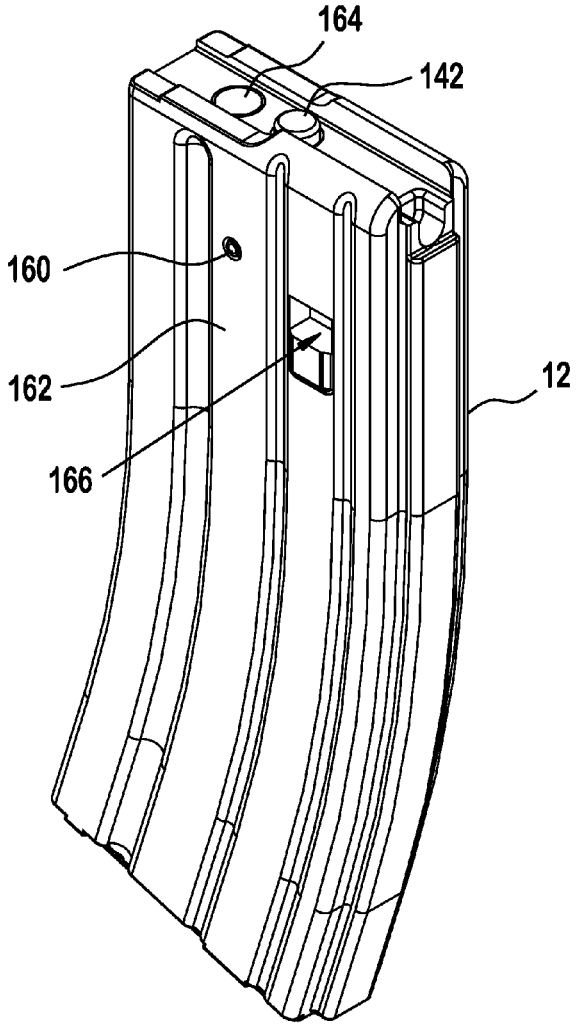
FIG. 7 is a rear perspective view of the training magazine of FIG. 1.

As shown in FIG. 9, the inert, replica magazine 12 may include a cavity 152 extending from the top surface of the magazine toward the bottom of the magazine. The cavity 152 may contain a spring loaded button 142. The spring loaded button 142 may include a compression spring 154 and a plunger 156. The plunger 156 may include an elongated recess 158. As shown in FIG. 3, a pin 160 may be disposed in the elongated recess 158 and secured to the wall 162 of the magazine in order to maintain compression of the spring 154 and prevent the plunger 156 from being ejected from the cavity 152. Referring to FIGS. 7 and 8, the inert, replica magazine 12 may include a metal core 164. The metal core 164 may be situated adjacent to the cavity 152. The metal core 164 may be included in the magazine to make the inert, replica magazine visible to metal detectors or radiographic security screening techniques. The metal core 164 may be made, for example, from low carbon steel. The inert, replica magazine may further include a catch window 166. The catch window 166 may be disposed on one side of the magazine. The catch window 166 may be positioned on the magazine such that when the magazine is fully inserted into the magazine well 22, the catch 25 from the receiver portion 14 is disposed in the catch window 166 to block movement of the magazine 12.

Figure 2:
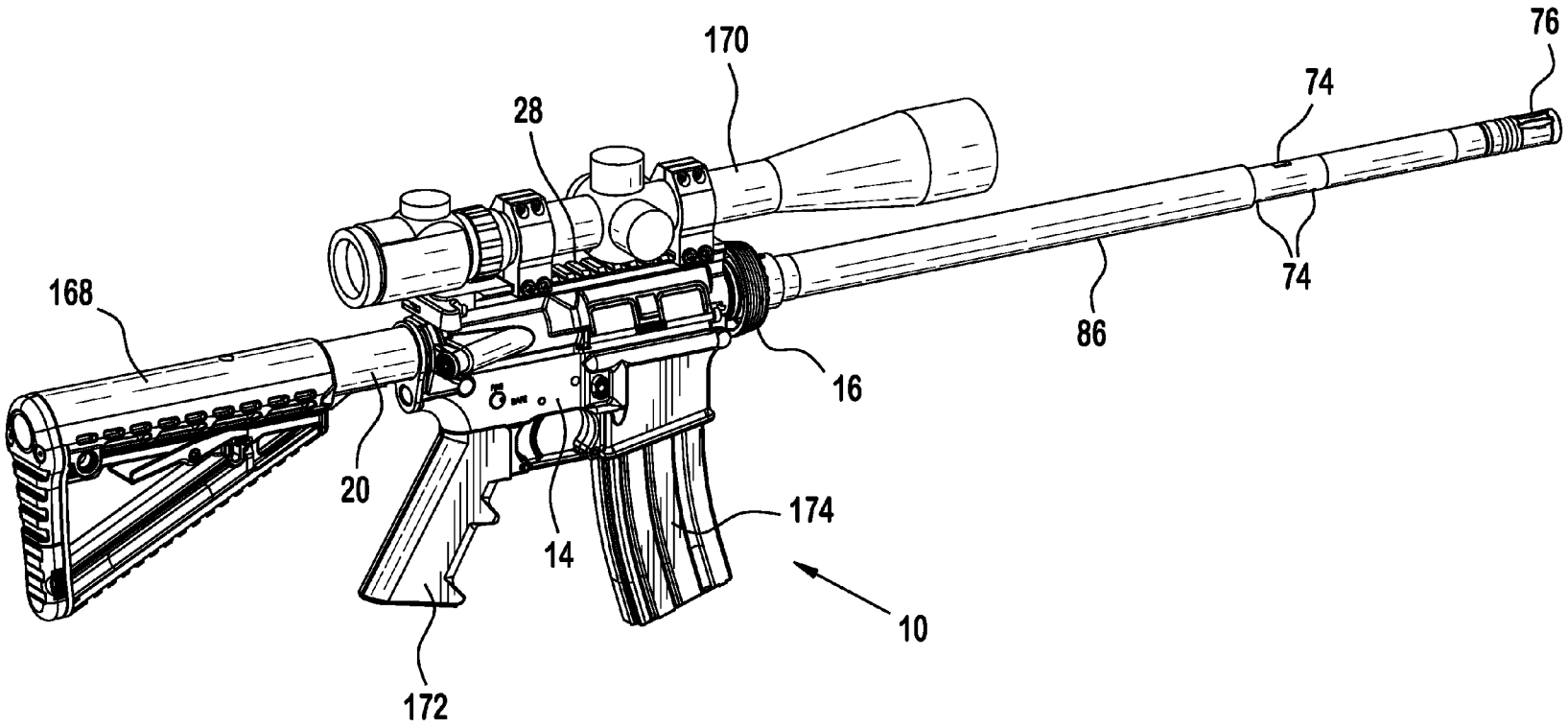
FIG. 2 is a rear perspective view of the training rifle of FIG. 1 with selected parts and tactical accessories.

In use, the modular components of the training rifle system may be assembled to provide a customized training rifle that utilizes parts and tactical accessories which the user selects. For example, FIG. 2 shows the modular receiver portion of FIG. 1 with a 20-inch barrel 86 (without a front sight), a collapsible stock 168 mounted on the receiver extension tube 20, an optical scope 170 mounted on the receiver portion's Piccatiny rail 28, and a pistol grip 172 connected to the pistol grip attachment site 34. Also, a magazine 174 for AR-15 series rifle is loaded into the magazine well. As illustrated in FIG. 2, various parts and tactical accessories may be coupled to the training rifle. The various parts and tactical accessories may be selected to simulate the configuration of a trainee's duty weapon or for mission specific training. Additionally, the functionality of the magazine catch may be used with a compatible magazine to simulate magazine changes. For example, the inert, replica magazine 12 may be used. In another example, a real magazine may be used to provide a more realistic training experience. In yet another example, a real magazine with live ammunition may be used with the training rifle to provide an even more realistic training experience. The modular components of the training rifle system also may be used for demonstrations and as a marketing platform for showcasing new parts and accessories. This may be particularly useful for trade shows or public events due to the safety concerns and logistics involved with transporting and displaying a working firearm.

While it has been illustrated and described what at present are considered to be preferred embodiments of the present invention, it will be understood by those skilled in the art that various changes and modifications may be made, and equivalents may be substituted for elements thereof without departing from the true scope of the invention. For example, a threaded fastener and mating attachment site on the simulated barrel nut and barrel may be used to secure the barrel to the modular receiver, instead of using the spring pin and cross bore which are described above. Additionally, features and/or elements from any embodiment may be used singly or in combination with other embodiments. Therefore, it is intended that this invention not be limited to the particular embodiments disclosed herein, but that the invention include all embodiments falling within the scope and the spirit of the present invention.

What is claimed is:

1. A polymer training rifle comprising:

an inert modular barrel having a proximal end, a distal end, and a first longitudinal axis extending from the proximal end to the distal end, which comprises a barrel extension segment adjacent the proximal end which comprises, a tapered cylindrical portion aligned with the first longitudinal axis, and a projection extending from the tapered cylindrical portion which comprises, a first slot aligned with the first longitudinal axis, a second slot perpendicular to the first slot, the second slot intersecting the first slot, and a fastener attachment member which comprises a threaded opening such that the fastener attachment member is disposed in the second slot and the threaded opening is aligned with the first slot, and a modular receiver having a front end and a rear end which comprises, a barrel attachment site on the front end which comprises, a rim which defines a first projection, and an opening extending from the first projection into the modular receiver, such that the opening defines a socket for receiving the barrel extension segment, which comprises, an upper end wall, a lower end wall, and a surface connecting the upper end wall to the lower end wall, a receiver extension tube attachment site on the rear end of the modular receiver which comprises a threaded cylindrical bore extending from the rear end into the modular receiver, a cavity within the modular receiver, the cavity being situated between the threaded cylindrical bore and an interior end wall that is spaced from the socket, and a passage extending from the interior end wall to the upper end wall, and a fastener which comprises a head and an elongated body such that the elongated body is disposed in the passage and a portion of the elongated body mates with the threaded opening of the fastener attachment member to fix the barrel extension segment within the socket.

2. The training rifle of claim 1, wherein the inert modular barrel further comprises:

a cross bore having a second longitudinal axis that is substantially perpendicular to the first longitudinal axis, the cross bore being disposed between the barrel extension segment and the distal end, and a retaining ring disposed between the barrel extension segment and the cross bore.

3. The training rifle of claim 2, wherein the retaining ring abuts the rim.

4. The training rifle of claim 3, further comprising a barrel nut wherein the retaining ring is locked between the rim and the barrel nut.

5. The training rifle of claim 4, further comprising a fastener, wherein the barrel nut further comprises a pair of opposing holes such that the fastener is disposed in the cross bore and in the pair of opposing holes to block relative movement between the barrel extension segment and the modular receiver.

6. The training rifle of claim 1, further comprising a pistol grip attachment site.

7. The training rifle of claim 6, wherein the pistol grip attachment site comprises a fastener bore, a window connected to the fastener bore, and a square nut disposed in the window.

8. The training rifle of claim 7, wherein the modular receiver further comprises a metal core.

9. The training rifle of claim 8, wherein the inert modular barrel further comprises a metal core.

10. The training rifle of claim 1, wherein the projection extending from the tapered cylindrical portion has a hemispherical cross-sectional profile.

11. The training rifle of claim 1, further comprising a receiver extension tube connected to the receiver extension tube attachment site.

12. The training rifle of claim 11, wherein the receiver extension tube comprises four notches for capturing a rifle stock locking pin.

13. The training rifle of claim 1, wherein the modular barrel and receiver portion are connected to simulate a carbine having a 16-inch barrel length.

14. The training rifle of claim 1, wherein the modular barrel and receiver portion are connected to simulate a mid-length rifle having a 16-inch barrel length.

15. The training rifle of claim 1, wherein the modular barrel and receiver portion are connected to simulate a rifle having a 20-inch barrel length.

16. The training rifle of claim 1, wherein the modular receiver further comprises a magazine well and a magazine catch assembly which comprises a magazine catch button and a magazine catch.

17. The training rifle of claim 16, wherein the modular receiver further comprises a ridged portion above the magazine well such that the ridged portion simulates the contour of a bolt carrier.

18. The training rifle of claim 17, further comprising a magazine which comprises a spring loaded member, the magazine being loaded into the magazine well such that the magazine is locked in the magazine well by the magazine catch, and such that contact pressure from the ridged portion against the spring loaded member compresses the spring loaded member.

19. The training rifle of claim 18, wherein the magazine is an inert training magazine which comprises a metal core.

20. The training rifle of claim 1, wherein the modular receiver further comprises a Picatinny rail.

* * * * *